US010012203B2

(12) United States Patent
Sano et al.

(10) Patent No.: US 10,012,203 B2
(45) Date of Patent: Jul. 3, 2018

(54) IGNITION COIL FOR INTERNAL COMBUSTION ENGINE

(71) Applicant: DENSO CORPORATION, Kariya, Aichi-pref. (JP)

(72) Inventors: Masafuyu Sano, Kariya (JP); Junichi Wada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/525,641

(22) PCT Filed: Nov. 6, 2015

(86) PCT No.: PCT/JP2015/081300

§ 371 (c)(1),
(2) Date: May 10, 2017

(87) PCT Pub. No.: WO2016/076218

PCT Pub. Date: May 19, 2016

(65) Prior Publication Data

US 2017/0321648 A1 Nov. 9, 2017

(30) Foreign Application Priority Data

Nov. 11, 2014 (JP) ..... 2014-229107

(51) Int. Cl.
*H01T 13/04* (2006.01)
*F02P 3/055* (2006.01)
(Continued)

(52) U.S. Cl.
CPC ..... *F02P 3/0556* (2013.01); *F02P 13/00* (2013.01); *F02P 15/12* (2013.01); *H01F 27/425* (2013.01);
(Continued)

(58) Field of Classification Search
CPC ..... F02P 3/0556; F02P 13/00; F02P 15/12; F02P 9/007; H01F 27/306; H01F 27/425; H01F 38/12; H01T 13/04; F02F 1/242
(Continued)

(56) References Cited

U.S. PATENT DOCUMENTS 5,357,233 A * 10/1994 Wada ..... H01F 38/12 123/634
5,419,300 A * 5/1995 Maruyama ..... F02P 3/02 123/634
5,487,676 A * 1/1996 Maruyama ..... F02P 3/02 324/399
5,492,105 A * 2/1996 Nakajima ..... F02P 13/00 123/169 PA
5,537,983 A * 7/1996 Nakajima ..... F02P 3/02 123/169 PA
5,618,193 A * 4/1997 Nakajima ..... F02P 3/02 123/143 C
5,685,282 A * 11/1997 Murata ..... F02P 3/02 123/169 PA
(Continued)

FOREIGN PATENT DOCUMENTS

JP 5294209 6/2013

*Primary Examiner* — Hai Huynh
(74) *Attorney, Agent, or Firm* — Nixon & Vanderhye P.C.

(57) ABSTRACT

In an ignition coil for an internal combustion engine, a resistor is disposed in a tower insertion hole of a high-voltage tower section. A coil spring is inserted in the tower insertion hole. An inner diameter of a proximal end side portion of the tower insertion hole is larger than an outer diameter of a maximum outer diameter portion of the resistor. An inner diameter of the distal end side portion of the tower insertion hole is larger than an outer diameter of a proximal end side portion of the coil spring, and is smaller than the outer diameter of the maximum outer diameter portion. In a state where the coil spring is pulled out from the tower insertion hole, the maximum outer diameter portion is restrained by the distal end side portion of the tower insertion hole, and a gap is formed between the resistor and a high-voltage cap.

5 Claims, 6 Drawing Sheets

(51) Int. Cl.

| | |
|---|---|
| ***F02P 15/12*** | (2006.01) |
| ***F02P 13/00*** | (2006.01) |
| ***H01F 27/42*** | (2006.01) |
| *F02P 9/00* | (2006.01) |
| *H01F 38/12* | (2006.01) |
| *H01F 27/30* | (2006.01) |

(52) U.S. Cl.
CPC ..... *F02P 9/007* (2013.01); *H01F 27/306* (2013.01); *H01F 38/12* (2013.01)

(58) Field of Classification Search
USPC ..... 123/169 PA
See application file for complete search history.

(56) References Cited

U.S. PATENT DOCUMENTS

| | | | | |
|---|---|---|---|---|
| 5,827,079 | A * | 10/1998 | Murata | F02P 3/02 439/125 |
| 6,023,215 | A * | 2/2000 | Sakamaki | F02P 3/02 123/634 |
| 7,013,883 | B2 * | 3/2006 | Shimada | F02P 3/02 123/169 PA |
| 7,317,370 | B2 * | 1/2008 | Nakamoto | H01F 38/12 123/634 |
| 9,194,359 | B2 * | 11/2015 | Steinberger | F02P 13/00 |

* cited by examiner

IGNITION COIL FOR INTERNAL COMBUSTION ENGINE

CROSS-REFERENCE TO RELATED APPLICATION

This application is the U.S. National Phase of International Application No. PCT/JP2015/081300 filed on Nov. 6, 2015, published in Japanese as WO 2016/076218 A1 on May 19, 2016, which designated the U.S., and is based on and claims the benefit of priority from Japanese Patent Application No. 2014-229107, filed Nov. 11, 2014. The entire disclosures of all of the above applications are incorporated herein by reference.

TECHNICAL FIELD

The present invention relates to an ignition coil for an internal combustion engine that generates a spark for ignition in an ignition plug.

BACKGROUND ART

Some ignition coils for internal combustion engines include a coil section that is disposed outside a plug hole. The coil section includes a primary coil and a secondary coil. The secondary coil includes a high-voltage winding end portion that is connected to an ignition coil disposed inside the plug hole using a pole joint or the like. In the ignition coil, a high-voltage tower section is disposed in the plug hole, and is mounted to a coil case configuring the coil section. A resistor is disposed in an insertion hole of the high-voltage tower section. A coil spring is inserted from an insertion hole of the pole joint to an insertion hole of the high-voltage tower section, and comes into contact with the resistor.

For example, in an ignition coil for an internal combustion engine disclosed in PTL 1, an inward protrusion section supporting the lower surface of the resistor is disposed in a cylindrical inner wall of a high-voltage cylindrical section of an insulating case. PTL 1 discloses that a high-voltage terminal is disposed to be in contact with the upper surface of the resistor, and is electrically conductive to a high voltage winding end of the secondary coil.

CITATION LIST

Patent Literature

[PTL 1] Japanese Patent No. 5294209

SUMMARY OF THE INVENTION

Technical Problem

The ignition coil disclosed in PTL 1 includes a resistor made of a ceramic material or the like, and is fixed by being sandwiched between the high voltage terminal and the inward protrusion section. Thus, when the high voltage terminal is assembled to the cylindrical inner wall of the high-voltage cylindrical section, a large assembly load may be applied to the resistor that is arranged on the cylindrical inner wall of the high-voltage cylindrical section. In this case, the resistor may be damaged. The high-voltage cylindrical section, the resistor, and the high-voltage terminal are configured by different materials having different linear expansion coefficients. Thus, when the ignition coil is used, a large thermal stress may be applied to the resistance body. In this case, the resistor may be damaged.

Further, the inward protrusion disposed in the cylindrical inner wall of the high-voltage cylindrical section sharply increases a wall thickness of the high-voltage cylindrical section. Thus, due to formation of the inward protrusion section, when the insulating case is formed, voids (air bubbles) within the resin are likely to occur in the resin configuring the high-voltage cylindrical section. As a result, in the high-voltage cylindrical section, strength may be lowered and withstand voltage may be lowered.

The present invention has been made in view of the above-described issues. The present invention provides an ignition coil for an internal combustion engine that can establish both detachment prevention of a resistor and protection of a resistor, and can reduce voids (air bubbles) within the resin in a high-voltage tower section.

Solution to Problem

An embodiment of the present invention provides an ignition coil for an internal combustion engine, the ignition coil including: a primary coil and a secondary coil; a coil case that includes a housing section and a high-voltage tower section, the housing section housing the primary coil and the secondary coil, and being disposed outside a plug hole of a cylinder for an internal combustion engine in which an ignition plug is disposed, the high-voltage tower section being disposed in the housing section such that at least a section of the high-voltage tower section is located within the plug hole; a rubber seal that is attached to an outer periphery of the high-voltage tower section; a pole joint that is disposed within the plug hole and attached to the high-voltage tower section via the rubber seal; a resistor that is disposed in a tower insertion hole formed in a central portion of the high-voltage tower section; a coil spring that is continuously inserted in a joint insertion hole formed in the pole joint and a distal end side portion of the tower insertion hole, and is in contact with the resistor; and a high-voltage cap that is attached to a proximal end side of the high-voltage tower section, and allows the resistor and a high-voltage winding end portion of the secondary coil to be electrically connected to each other. An inner diameter of a proximal end side portion in the tower insertion hole is larger than an outer diameter of a maximum outer diameter portion in the resistor. An inner diameter of the distal end side portion of the tower insertion hole is larger than an outer diameter of a proximal end side portion in the coil spring and is equal to or smaller than the outer diameter of the maximum outer diameter portion of the resistor. The ignition coil for an internal combustion engine is configured such that in a state where the coil spring is pulled out from the tower insertion hole, the maximum outer diameter portion of the resistor is restrained by the distal end side portion of the tower insertion hole, and a gap is formed between the resistor and the high-voltage tower section.

Advantageous Effects of Invention

In the ignition coil for an internal combustion engine (hereinafter simply referred to as an ignition coil), the shape of the tower insertion hole of the high-voltage tower section in the coil case is devised as follows. Specifically, the inner diameter of the proximal end side portion of the tower insertion hole is larger than the outer diameter of the maximum outer diameter portion of the resistor. The inner diameter of the distal end side portion of the tower insertion hole is larger than the outer diameter of the proximal end side portion of the coil spring and is equal to or smaller than the outer diameter of the maximum outer diameter portion of the resistor.

According to the configuration of the tower insertion hole, in a state where the coil spring is pulled out from the tower insertion hole, the maximum outer diameter portion of the resistor is restrained by the distal end side portion of the tower insertion hole. Thus, in a case where the ignition coil is assembled or in a case where maintenance of the ignition is performed or the like, when the coil spring is pulled out from the tower insertion hole, the resistor can be prevented from being detached outside the tower insertion hole.

When the ignition coil is assembled and when the high-voltage cap is attached to the proximal end side of the high-voltage tower section, a gap is formed between the resistor inserted in the tower insertion hole of the high-voltage tower section and the high-voltage cap. According to the formed gap, it is possible to prevent an assembling load, which is applied to the high-voltage cap, from being applied up to the resistor. Thus, the resistance can be prevented from being damaged.

In a state in which the ignition coil is assembled, the resistor is in contact with (conductive to) the high-voltage cap by an elastic repulsive force of the coil spring, and is held between the high-voltage cap and the coil spring. Since the resistor is held by the elastic repulsive force of the coil spring, when the ignition coil is used, a thermal stress caused by a difference in the coefficient of linear expansion is not applied to the resistor. Thus, the resistor can be protected from being damaged.

Further, the proximal end side portion and the distal end side portion of the tower insertion hole have a shape that is gently changed, and the high-voltage tower section has a wall thickness that is not sharply changed. Thus, when the coil case is molded, it is possible to reduce voids (air bubbles) within resin that occur in the resin configuring the high-voltage tower section. As a result, according to the above-described ignition coil for an internal combustion engine, it is possible to establish both detachment prevention of a resistor and protection of a resistor, and reduce voids (air bubbles) within resin in a high-voltage tower section.

DESCRIPTION OF EMBODIMENTS

An ignition coil for an internal combustion engine according to an embodiment will be described below with reference to the drawings. In the following drawings, reference signs L, R, and CR respectively indicate a center axis direction, a radial direction, and a circumferential direction of: a plug hole provided in each cylinder of an engine used as an internal combustion engine; and each member (each component) of an ignition coil for an internal combustion engine that is disposed in the plug hole.

First Embodiment

Figure 1:
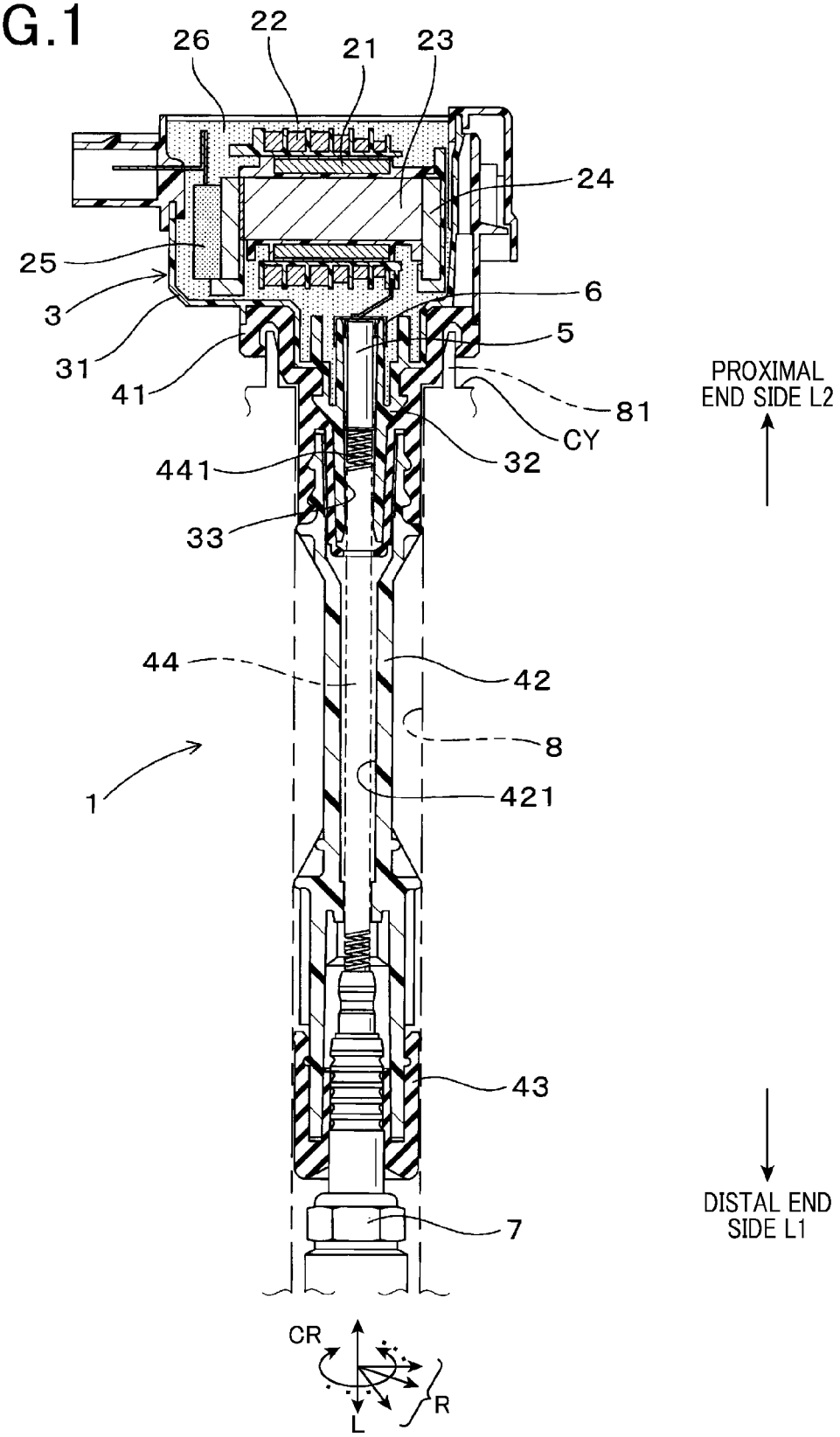
FIG. 1 is a cross-sectional view showing an ignition coil for an internal combustion engine according to a first embodiment.

As shown in FIG. 1, an ignition coil 1 for an internal combustion engine (hereinafter, referred to as an ignition coil 1) includes a primary coil 21, a secondary coil 22, a coil case 3 made of resin, a rubber seal 41, a pole joint 42 made of resin, a resistor 5 made of ceramic, a coil spring 44, and a high-voltage cap 6.

The coil case 3 includes a housing section 31 and a high-voltage tower section 32. The housing section 31 houses the primary coil 21 and the secondary coil 22, and is arranged outside a plug hole 8 in a cylinder CY. The high-voltage tower section 32 is disposed in the housing section 31 such that at least a part of the high-voltage tower section 32 is located within the plug hole 8 in the cylinder CY. The rubber seal 41 is attached to the outer periphery of the high-voltage tower section 32.

Figure 2:
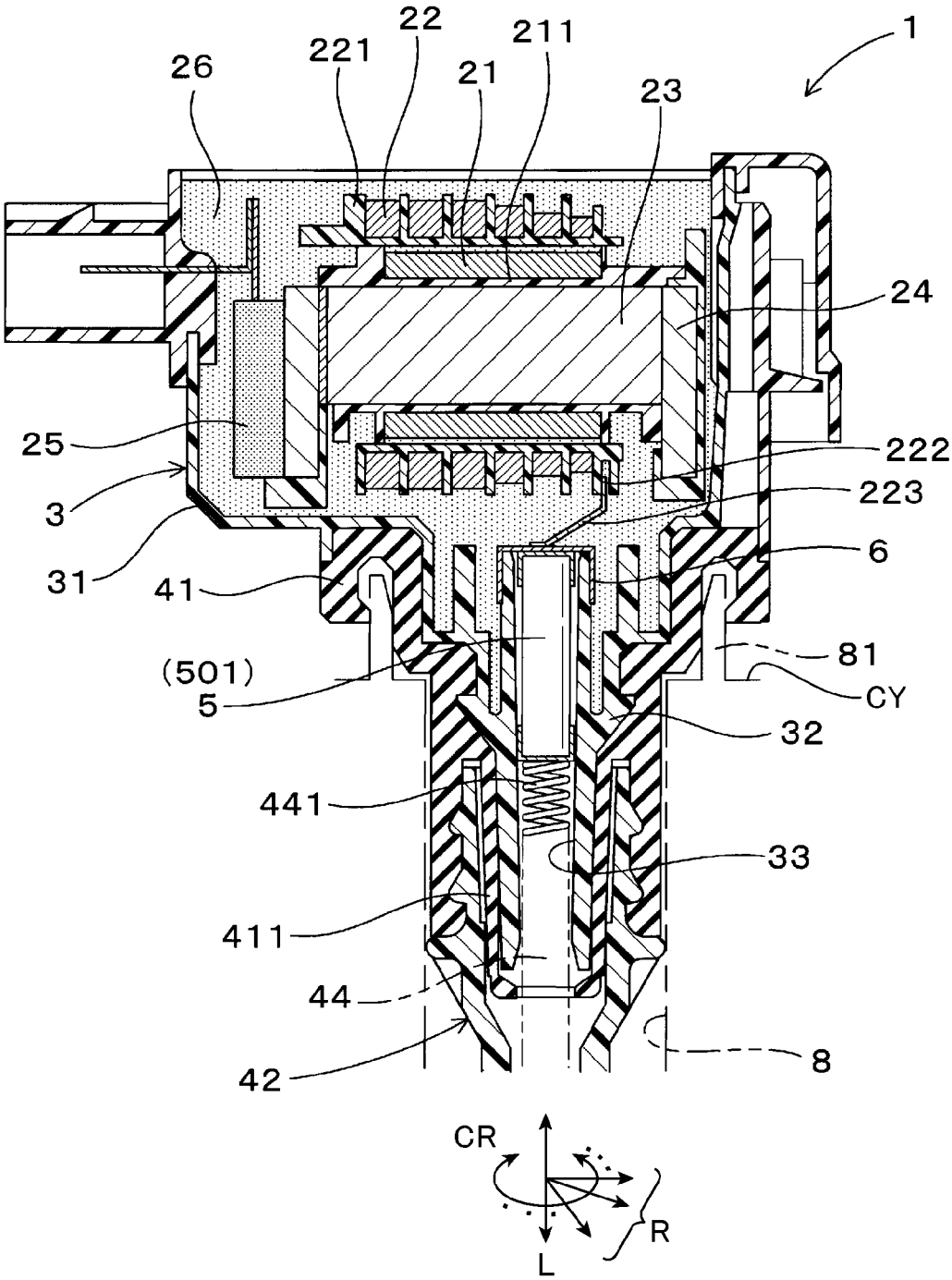
FIG. 2 is an enlarged cross-sectional view showing a part of the ignition coil for an internal combustion engine according to the first embodiment.

As shown in FIGS. 1 and 2, the pole joint 42 is arranged within the plug hole in the cylinder CY, and is attached to the high-voltage tower section 32 via the rubber seal 41. The resistor 5 is arranged in a tower insertion hole 33 that is formed in the central portion of the high-voltage tower section 32. The coil spring 44 is continuously inserted in a joint insertion hole 421, formed in the central portion of the pole joint 42, and a distal end side portion 331 of the tower insertion hole 33. The coil spring 44 is configured to generate an elastic repulsive force and to be in contact with the resistor 5. The high-voltage cap 6 is attached to the proximal end side of the high-voltage tower 32. The high-voltage cap 6 is configured such that the resistor 5 and a high-voltage winding end portion 222 of the secondary coil 22 are electrically connected to each other.

Figure 3:
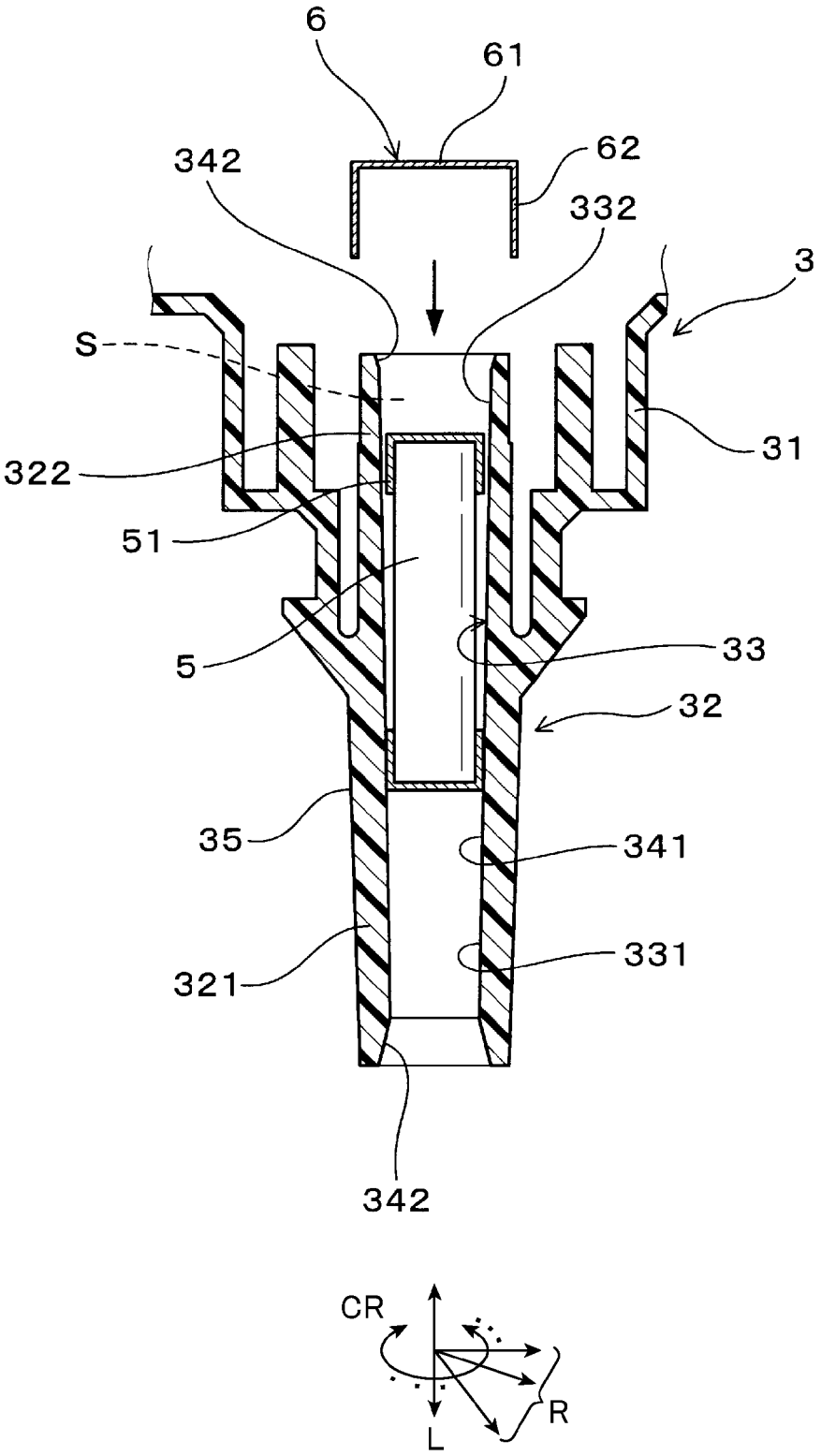
FIG. 3 is a cross-sectional view showing a state in which a high-voltage cap is attached to a high-voltage tower section when the ignition coil for an internal combustion engine according to the first embodiment is assembled.
Figure 4:
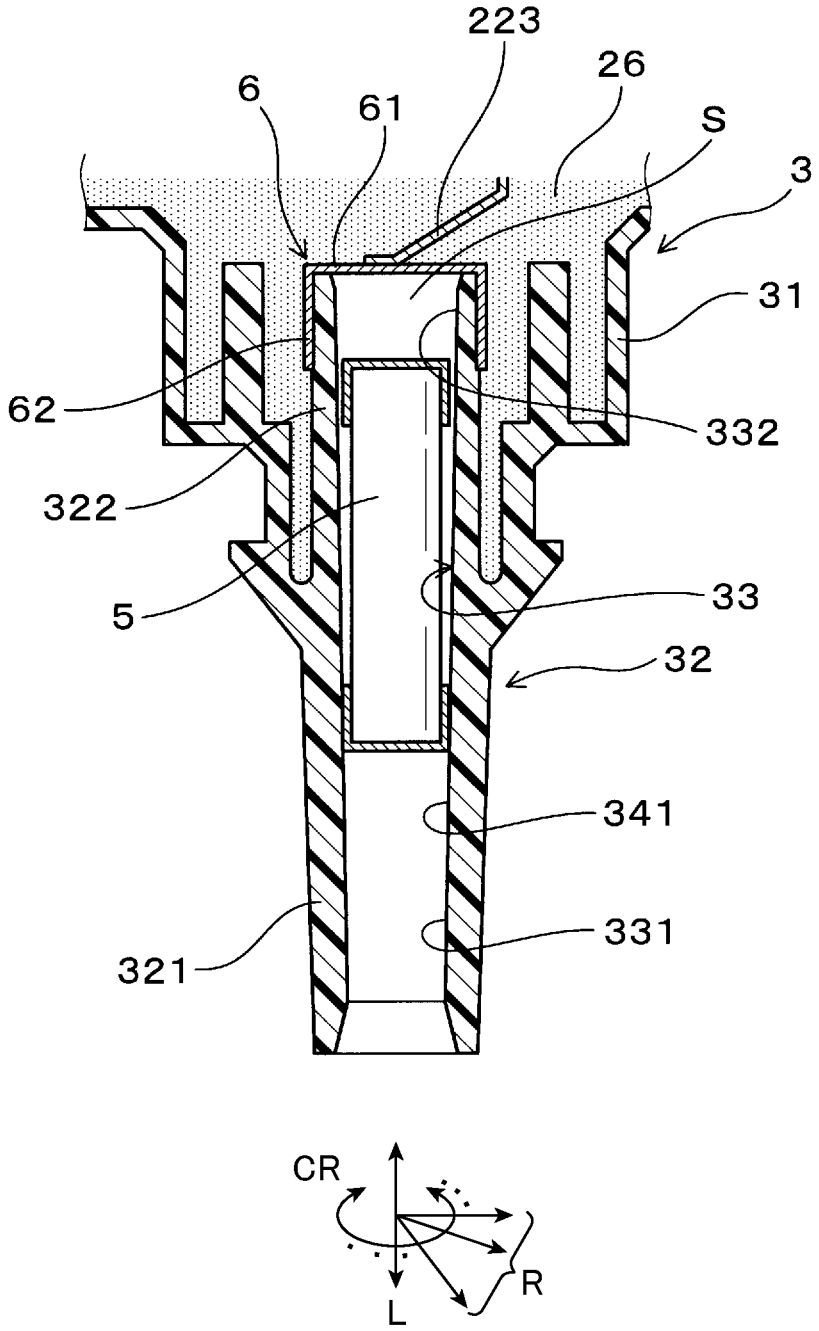
FIG. 4 is a cross-sectional view showing a state in which a coil spring is pulled out from a tower insertion hole when maintenance of the ignition coil for an internal combustion engine according to the first embodiment is performed.

The inner diameter of the proximal end side portion 332 of the tower insertion hole 33 is larger than the outer diameter of a maximum outer diameter portion of the resistor 5. The inner diameter of the distal end side portion 331 of the tower insertion hole 33 is larger than the inner diameter of a proximal end side portion 441 of the coil spring 44, and is smaller than the outer diameter of the maximum outer diameter portion of the resistor 5. As shown in FIGS. 3 and 4, the ignition coil 1 is configured such that in a state where the coil spring 44 is pulled out from the tower insertion hole 33, the maximum outer diameter portion of the resistor 5 is restrained by the distal end side portion 331 of the tower insertion hole 33, and a gap S is formed between the resistor 5 and the high-voltage cap 6.

Here, FIG. 3 shows a state in which the high-voltage cap 6 is attached to the high-voltage tower section 32 when the ignition coil 1 is assembled, and FIG. 4 shows a state in which the coil spring 44 is pulled out from the tower insertion hole 33 when maintenance of the ignition coil 1 is performed.

A distal end side L1 refers to a side at which an ignition plug 7 is located with respect to the ignition plug 1. In the present embodiment, the distal end side L1 refers to a lower side in each figure. A proximal end side L2 refers to a side opposite to the distal end side. In the present embodiment, the proximal end side L2 refers to an upper side in each figure.

With reference to FIGS. 1 to 5, the ignition coil 1 of the present embodiment will be described below in detail.

As shown in FIG. 1, the ignition coil 1 is arranged on each cylinder CY of an engine used as an internal combustion engine, and is used to generate a spark in the ignition plug 7 arranged in the plug hole 8 in each cylinder CY.

As shown in FIG. 2, the primary coil 21 and the secondary coil 22 are concentrically arranged so as to overlap each other in inner and outer peripheries. A center core 23 is arranged in the inner peripheral side of the primary coil 21 and the secondary coil 22. An outer peripheral core 24 is arranged in the outer peripheral side of the primary coil 21 and the secondary coil 22. The center core 23 and the outer peripheral core 24 form a closed magnetic path through which a magnetic flux passes. The primary coil 21 is wound around the outer periphery of a primary spool 211 made of resin. The secondary coil 22 is wound around the outer periphery of a secondary spool 221 made of resin. The primary coil 21 and the secondary coil 22 are made of a soft magnetic material.

The primary coil 21, the secondary coil 22, the center core 23, and the outer peripheral core 24 are arranged in the housing section 31 in the coil case 3. An igniter 25 is arranged in the housing section 31. The igniter 25 includes a switching element that energizes the primary coil 21 and interrupts the energization to the primary coil 21. A space formed in the housing section 31 is filled with a casting resin 26 such as a thermosetting resin.

As shown in FIG. 3, the high-voltage tower section 32 in the coil case 3 includes an outward protrusion section 321 and an inward protrusion section 322. The outward protrusion section 321 protrudes outward the coil case 3. The inward protrusion section 322 protrudes toward the inside of the coil case 3. The outward protrusion section 321 is arranged in the plug hole 8 in the cylinder CY. The high-voltage cap 6 is attached to the inward protrusion section 322. The tower insertion hole 33 is formed through the central portion of the outward protrusion section 321 and the inward protrusion section 322.

As shown in FIGS. 1 and 2, the rubber seal 42 is configured to seal between the outer periphery of the outward protrusion section 321 of the high-voltage tower section 32 and an opening end portion 81 of the plug hole 8 in the cylinder CY. In the rubber seal 42, a fastening section 411 is formed to fasten the high-voltage tower section 32 and the pole joint 42.

A plug cap 43 is attached to the distal end side portion of the pole joint 42. The plug cap 43 is made of rubber, and is mounted to the ignition plug 7 attached to the engine. The pole joint 42 is connected between the high-voltage tower section 32 and the plug cap 43, and surrounds the outer periphery of the coil spring 44.

As shown in FIG. 3, a tapered hole section 341, which has a diameter that is reduced from the proximal end side toward the distal end side, is formed in the tower insertion hole 33 of the high-voltage tower section 3 of the present embodiment. A chamfered portion 342 is formed in an opening portion of the distal end side and an opening portion of the proximal end side of the tower insertion hole 33. The whole of the tower insertion hole 33 other than the chamfered portion 342 is formed by the tapered hole section 341. The proximal end side portion 332 of the tower insertion hole 33 is formed by the proximal end side portion of the tapered hole section 341. The distal end side portion of the tower insertion hole 33 is formed by the distal end side portion of the tapered hole section 341.

A conductive cap 51, which secures conductivity of the resistor 5, is disposed in both end portions of the axial direction of the resistor 5. The outer diameter is constant, and the maximum outer diameter portion of the resistor 5 is both end portions in which the conductive cap 51 is disposed. The minimum inner diameter of the distal end side portion 331 of the tapered hole section 341 is smaller than the outer diameter of the maximum outer diameter portion of the conductive cap 51 in the resistor 5. In a state where the coil spring 44 is pulled out from the tower insertion hole 33, the maximum outer diameter portion in the conductive cap 51, which is disposed in the end portion of the distal end side of the resistor 5, comes into contact with the tapered inner peripheral surface of the tapered hole section 341. Thus, the resistor 5 is restrained by the tapered hole section 341.

As shown in FIG. 3, the axial direction length of the tapered hole section 341 is longer than the axial direction length of the resistor 5. When the ignition coil 1 is in an assembled state (see FIG. 2) in which the ignition coil 1 is pressed against the high-voltage cap 6 by the coil spring 44, and when the ignition coil 1 is in an disassembled state (see FIG. 4) in which the ignition coil 1 is pulled out from the tower insertion hole 33, a state in which the resistor 5 is arranged in the tapered hole section 341 is maintained.

The high-voltage cap 6 of the present embodiment includes a disk section 61, a cylindrical outer peripheral section 62 that is cylindrically formed around the outer periphery of the disk section 61. The cylindrical outer peripheral section 62 is fitted into the outer periphery of the inward protrusion section 322 of the high-voltage tower section 32. Thus, the high-voltage cap 6 is attached to the inward protrusion section 322. The disk section 61 of the high-voltage cap 6 is in contact with the resistor 5.

As shown in FIG. 2, a conductive metal fitting 223, which is connected to the high-voltage winding end portion 222 of the secondary coil 22, is provided in the secondary spool 221. The conductive metal fitting 223 is in contact with the disk section 61 of the high-voltage cap 6.

Figure 5:
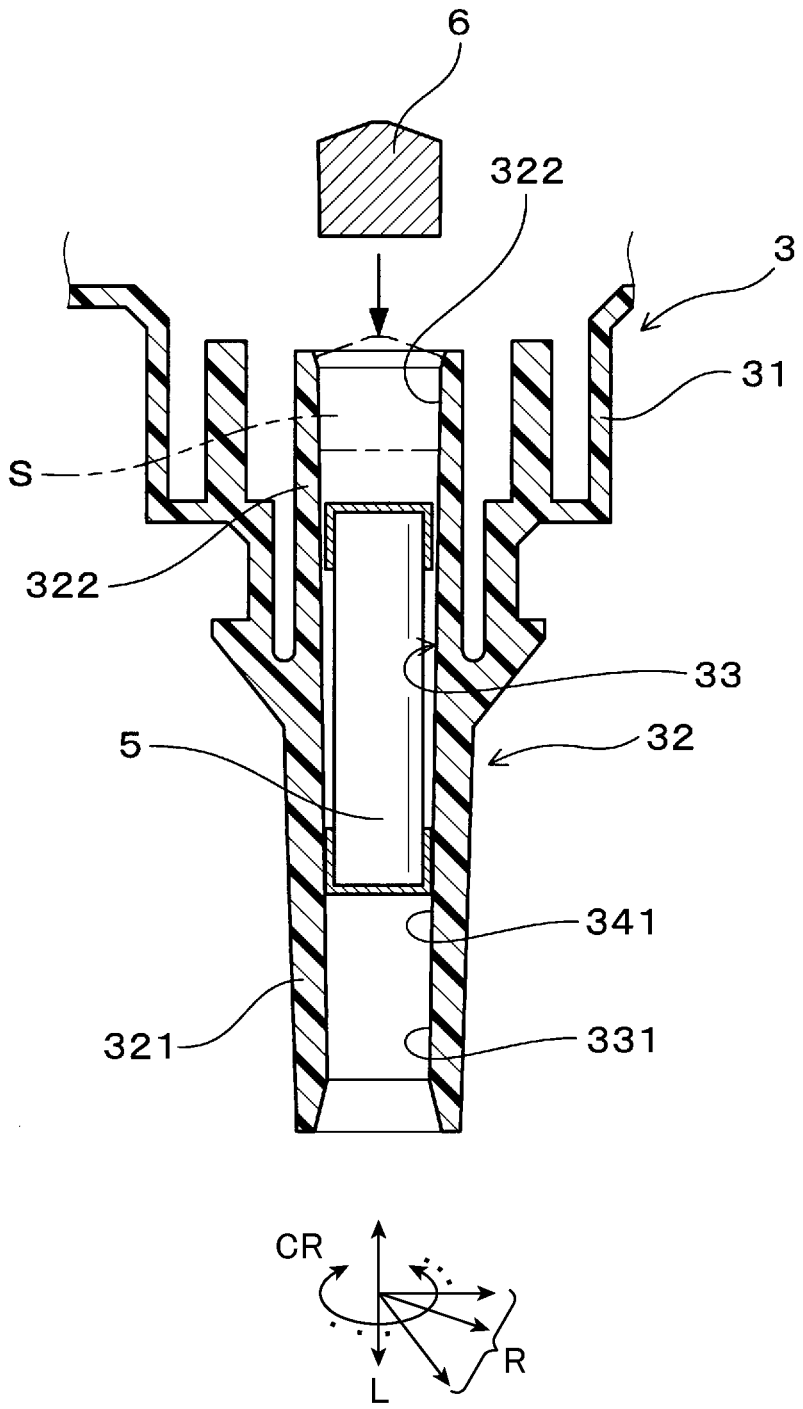
FIG. 5 is a cross-sectional view showing the high-voltage tower section in which other high-voltage cap is disposed in the ignition coil for an internal combustion engine according to the first embodiment is assembled.

The high-voltage cap 6 has a function for preventing the casting resin 26 from leaking from the housing section 31 of the coil case 3 to the tower insertion hole 33 of the high-voltage tower section 32. The high-voltage cap 6 may be formed into various shapes having this function, for example, as shown in FIG. 5, a shape that is fitted into the tower insertion hole 33 of the inward intrusion section 322.

As shown in FIG. 3, a tapered outer periphery section 35, which has a diameter that is reduced from the proximal end side L2 toward the distal end side L1, is formed in an outer peripheral side of a position in which at least the tapered hole section 341 is formed in the outer peripheral surface of the outward protrusion section 321 of the high-voltage tower section 32. The formed tapered outer periphery section 35 enables a thickness of a part of the high-voltage tower section 32, in which the tapered hole section 341 is formed, to be approximately uniform in the longitudinal direction of the tapered hole section 341. This makes it possible to reduce void (air bubble) generated in the high-voltage tower section 32 when the coil case 3 is molded. Thus, the strength and withstand voltage of the high-voltage tower section 32 can be easily secured.

The outer peripheral surface of the outward protrusion section 321 of the high-voltage tower section 32 may be formed into a straight shape that is parallel to the central axis direction L of the high-voltage tower section 2.

As described above, the tapered hole section 341 is disposed in the tower insertion hole 33 of the present embodiment, and the minimum inner diameter of the distal end side portion 331 of the tapered hole section 341 is smaller than the outer diameter of the maximum outer diameter section in the conductive cap 51 of the resistor 5. Due to the formed tapered hole section 341, when the coil case 3 is molded, the high-voltage tower section 32, which is molded, can be likely to be released from its molding die. In addition, the axial direction length of the tapered hole section 41 is longer than the axial direction length of the resistor 5. Thus, the whole of the resistor 5 is arranged in the tapered hole section 41. According to the configuration of the tower insertion hole 33, as shown FIG. 4, in a state where the coil spring 44 is pulled out from the tower insertion hole 33, the maximum outer diameter section of the resistor 5 is restrained by the distal end side portion 331 of the tapered hole section 341.

As a result, in a case where the ignition coil 1 is assembled or in a case where maintenance of the ignition coil 1 is performed or the like, when the coil spring 44 is pulled out from the tower insertion hole 33, the resistor 5 can be prevented from being detached outside the tower insertion hole 33.

The minimum inner diameter of the distal end side portion 331 of the tapered hole section 341 may be equal to the outer diameter of the maximum outer diameter portion of the resistor 5. Even in this case, it is possible to obtain the same actions and effects as the case where the minimum inner diameter of the distal end side portion 331 is smaller than the outer diameter of the maximum outer diameter portion of the resistor 5.

As shown in FIG. 3, when the ignition coil 1 is assembled and when the high-voltage cap 6 is attached to the inward protrusion section 322 of the high-voltage tower section 32, the resistor 5 is lowered from the final assembled position 501 (see FIG. 2) to the distal end side, and is restrained by the tapered hole section 341. Then, when the high-voltage cap 6 is assembled, the gap S is formed between the resistor 5 inserted in the tower insertion hole 341 and the high-voltage cap 6. According to the formed gap S, it is possible to prevent an assembling load, which is applied to the high-voltage cap 6, from being applied up to the resistor 5. Thus, the resistor 5 can be prevented from being damaged.

As shown in FIG. 2, in a state in which the ignition coil 1 is assembled, the resistor 5 comes in contact with the high-voltage cap 6 by an elastic repulsive force of the coil spring 44. Thus, the resistor 5 is held between the high-voltage cap 6 and the coil spring 44. The resistor 5 is held by the elastic repulsive force of the coil spring 44. Thus, when the ignition coil 1 is used, a thermal stress caused by a difference in the coefficient of linear expansion is not applied to the resistor 5. As a result, the resistor 5 can be protected from being damaged.

Further, the tower insertion hole 33 has a shape that is gently changed by the tapered hole section 341, and the high-voltage tower section 32 has a wall thickness that is not sharply changed. Thus, when the coil case 3 is molded, it is possible to reduce voids (air bubbles) within the resin configuring the high-voltage tower section 32. As a result, according to the ignition coil 1 of the present embodiment, it is possible to establish both detachment prevention of the resistor 5 and protection of the resistor 5, and reduce voids within resin in a high-voltage tower section 32.

Second Embodiment

The present embodiment shows a modification of the high-voltage tower section 32

Figure 6:
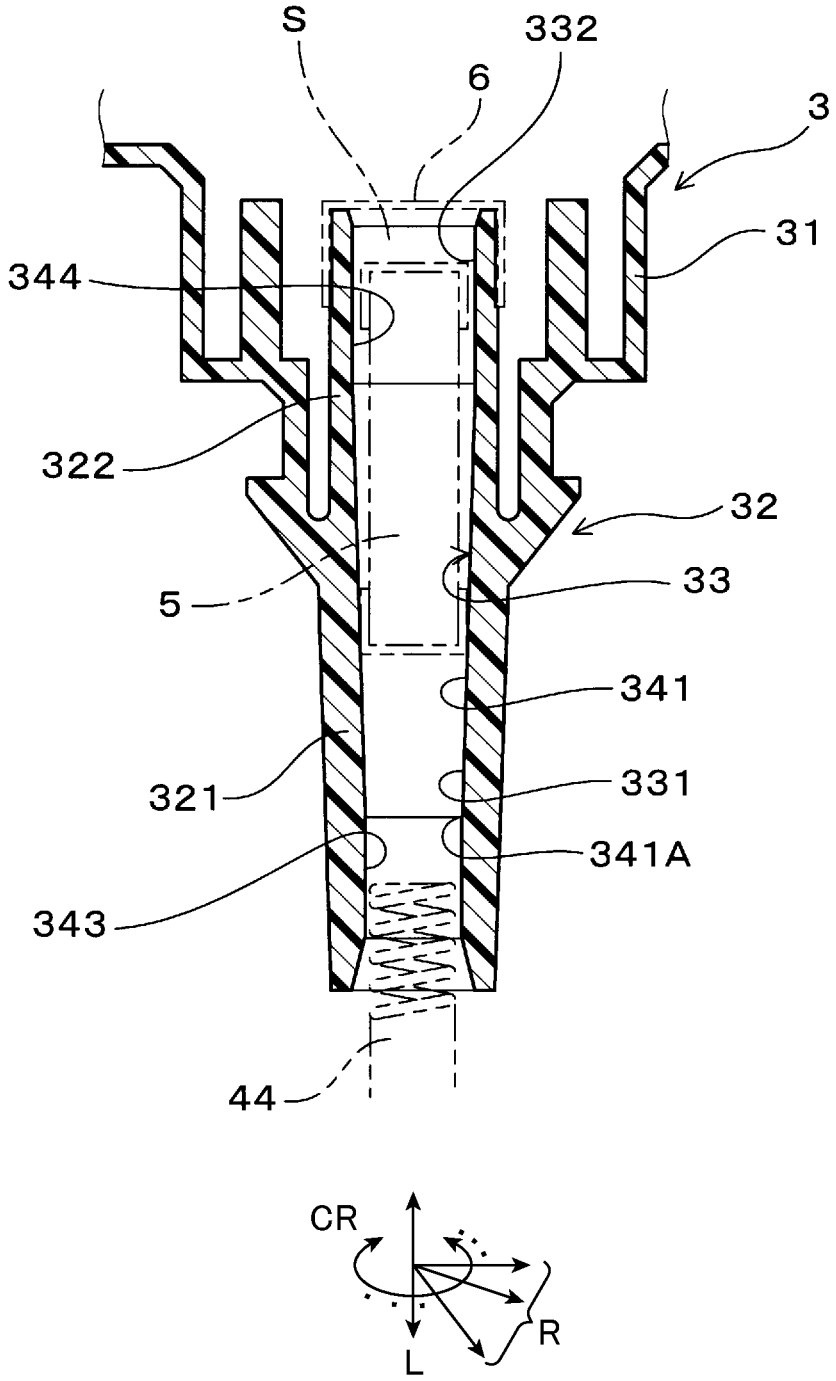
FIG. 6 is a cross-sectional view showing a periphery of the high-voltage tower section in the ignition coil for an internal combustion engine according to a second embodiment.

As shown in FIG. 6, a straight hole section 343, which has an inner diameter equal to an inner diameter of a distal end position 341A of the tapered hole section 341, may be formed in the distal end side of the tapered hole section 341 in the tower insertion hole 33 of the high-voltage tower section 32. In this case, the outer periphery of the coil spring 44 can be guided by the straight hole section 343. According to the straight hole section 343, the coil spring 44 is hardly inclined with respect to the center axis direction L of the high-voltage tower section 32. This makes it possible to prevent the coil spring 44 from bending toward the radial direction R, and to reduce a decrease in an elastic repulsive force of the coil spring 44. As a result, an electrical contact failure between the resistor 5 and the coil spring 44 hardly occurs even when vibration is generated in the engine.

As shown in the same figure, a straight hole section 344 on the proximal end side may be formed in the proximal end side portion 322 in the tower insertion hole 33 of the high-voltage section 32. The tapered hole section 341 may be formed in the distal end side of the straight hole section 344. The straight hole section 344 on the proximal end side may be formed in a part of the tower insertion hole 33 located in the inward protrusion section 322. The tapered hole section 341 may be formed in a part of the tower insertion hole 33 located in the outward protrusion section 321.

Even in the present embodiment, other elements and reference signs in the figure are the same as that of the first embodiment, and it is possible to obtain the same actions and effects as the first embodiment.

Other embodiments of the above-described ignition coil will be described below.

In the ignition coil, the tower insertion hole may include a tapered hole section having a diameter that is reduced from the proximal end side toward the distal end side. The proximal end side portion may be formed by including the proximal end side portion of the tapered hole section. The distal end side portion of the tower insertion hole may be formed by the distal end side portion of the tapered hole section.

In this case, the tapered hole section is formed in the tower insertion hole. Thus, the high-voltage tower section can have a wall thickness that is not sharply changed. Such simple shape is devised. Thus, it is possible to establish both detachment prevention of the resistor and protection of the resistor, and reduce void within resin in the high-voltage tower section when the high-voltage tower section is molded. In addition, the tapered hole section is formed. As a result, when the high-voltage tower section is molded, the high-voltage tower section, which is molded, can be likely to be released from its molding die.

A tapered outer periphery section, which has a diameter that is reduced from the proximal end side toward the distal end side, may be formed in an outer peripheral side of a position in which at least the tapered hole section is formed in the outer peripheral surface of the high-voltage tower section. In this case, the formed tapered outer periphery section enables a thickness of a part of the high-voltage tower section, in which the tapered hole section is formed, to be approximately uniform in the longitudinal direction of the tapered hole section. This makes it possible to reduce voids (air bubbles) generated in the high-voltage tower section when the coil case is molded. Thus, the strength and withstand voltage of the high-voltage tower section can be easily secured.

A straight hole section, which has an inner diameter that is equal to the inner diameter of the distal end position of the tapered hole section, may be formed in the distal end side of the tapered hole section. In this case, the outer periphery of the coil spring can be guided by the straight hole section. According to the straight hole section, the coil spring is not significantly inclined with respect to the center axis direction of the high-voltage tower section. This makes it possible to prevent the coil spring from bending toward the radial direction, and to reduce a decrease in an elastic repulsive force of the coil spring. As a result, an electrical contact failure between the resistor and the coil spring hardly occurs even when vibration is generated in the internal combustion engine.

REFERENCE SIGNS LIST

1: Ignition coil for internal combustion engine
21: primary coil
22: secondary coil
3: coil case
31: housing section
32: high-voltage tower section
33: tower insertion hole
331: distal end side portion
332: proximal end side portion
41: rubber seal
42: pole joint
421: joint insertion hole
44: coil spring
5: resistor
6: high-voltage cap
7: ignition plug
8: plug hole

What is claimed is:

1. An ignition coil for an internal combustion engine, the ignition coil comprising:

a primary coil and a secondary coil;

a coil case that includes a housing section and a high-voltage tower section, the housing section housing the primary coil and the secondary coil, the housing section being arranged outside a plug hole of a cylinder for an internal combustion engine in which an ignition plug is arranged, the high-voltage tower section being disposed in the housing section such that at least a section of the high-voltage tower section is located within the plug hole;

a rubber seal that is attached to an outer periphery of the high-voltage tower section;

a pole joint that is arranged within the plug hole and attached to the high-voltage tower section via the rubber seal;

a resistor that is disposed in a tower insertion hole formed in a central portion of the high-voltage tower section;

a coil spring that is continuously inserted in a joint insertion hole formed in the pole joint and a distal end side portion of the tower insertion hole to be in contact with the resistor; and a high-voltage cap that is attached to a proximal end side of the high-voltage tower section, and allows the resistor and a high-voltage winding end portion of the secondary coil to be electrically connected to each other, wherein:

an inner diameter of a proximal end side portion of the tower insertion hole is larger than an outer diameter of a maximum outer diameter portion of the resistor;

an inner diameter of the distal end side portion of the tower insertion hole is larger than an outer diameter of a proximal end side portion of the coil spring and is equal to or smaller than the outer diameter of the maximum outer diameter portion of the resistor; and the ignition coil is configured such that in a state where the coil spring is pulled out from the tower insertion hole, the maximum outer diameter portion of the resistor is restrained by the distal end side portion of the tower insertion hole, and a gap is formed between the resistor and the high-voltage tower section.

2. The ignition coil for an internal combustion engine according to claim 1, wherein:

the insertion hole includes a tapered hole section having a diameter that is reduced from an proximal end side toward an distal end side;

the proximal end side portion of the tower insertion hole is formed by including a proximal end side portion of the tapered hole section; and the distal end side portion of the tower insertion hole is formed by a distal end side portion of the tapered hole section.

3. The ignition coil for an internal combustion engine according to claim 2, wherein:

a tapered outer peripheral section is formed in an outer peripheral side of a position at which at least the tapered hole section is formed in an outer peripheral surface of the high-voltage tower section, the tapered outer peripheral section having a diameter that is reduced from an proximal end side toward an distal end side.

4. The ignition coil for an internal combustion engine according to claim 3, wherein:

a straight hole section is formed in a distal end side of the tapered hole section, the straight hole section having an inner diameter that is equal to an inner diameter of a distal end position of the tapered hole section.

5. The ignition coil for an internal combustion engine according to claim 2, wherein:

a straight hole section is formed in a distal end side of the tapered hole section, the straight hole section having an inner diameter that is equal to an inner diameter of a distal end position of the tapered hole section.

* * * * *